US009970191B2

(12) United States Patent
Hejazi et al.

(10) Patent No.: US 9,970,191 B2
(45) Date of Patent: May 15, 2018

(54) WALL PANEL DAMPING DEVICE

(71) Applicant: Universiti Putra Malaysia, Selangor (MY)

(72) Inventors: Farzad Hejazi, Selangor (MY); Mohd Saleh Jaafar, Selangor (MY); Mohd Azmi Mohd Zain, Selangor (MY)

(73) Assignee: Universiti Putra Malaysia, Selangor (MY)

( * ) Notice: Subject to any disclaimer, the term of this patent is extended or adjusted under 35 U.S.C. 154(b) by 0 days. days.

(21) Appl. No.: 15/534,265

(22) PCT Filed: Dec. 15, 2015

(86) PCT No.: PCT/MY2015/050153
§ 371 (c)(1),
(2) Date: Jun. 8, 2017

(87) PCT Pub. No.: WO2016/099252
PCT Pub. Date: Jun. 23, 2016

(65) Prior Publication Data

US 2017/0362821 A1 Dec. 21, 2017

(30) Foreign Application Priority Data

Dec. 15, 2014 (MY) ..... PI2014703806

(51) Int. Cl.
*E04B 1/98* (2006.01)
*E04B 1/61* (2006.01)
(Continued)

(52) U.S. Cl.
CPC ..... *E04B 1/98* (2013.01); *E04B 1/24* (2013.01); *E04B 1/61* (2013.01); *E04H 9/022* (2013.01)

(58) Field of Classification Search
CPC ..... E04B 1/98; E04B 1/61; E04B 1/24; E04H 9/022
See application file for complete search history.

(56) References Cited

U.S. PATENT DOCUMENTS 1,061,918 A * 5/1913 Meyer ..... E04B 1/24 52/206
2,318,944 A * 5/1943 Ingersoll ..... E04B 1/98 160/392

(Continued)

FOREIGN PATENT DOCUMENTS

JP 64/83775 A 3/1989
JP 2000/110400 A 4/2000
JP 2010/1700 A 1/2010

OTHER PUBLICATIONS

International Preliminary Report on Patentability for PCT/MY2015/050153 dated Jun. 20, 2017 (4 pages).*

*Primary Examiner* — Rodney Mintz
(74) *Attorney, Agent, or Firm* — Cesari and McKenna, LLP

(57) ABSTRACT

The present invention provides a viscoelastic wall panel damping device (100) that provides damping against multidirectional reacting dynamic loads that include in-plane shear force resistance and out of plane force resistance. The viscoelastic wall panel damping device (100) of the present invention, including an assembly (100*a*) having a pair of symmetrically opposing surfaces formed by a pair of damping element planar members (36*a*, 38*b*) that sandwiches a rigid planar member (34). The assembly (100*a*) being overlaid by a pair of face plates (28, 32), a proximal face plate (28) and a distal face plate (32). Aforementioned pair of face plates (28, 32) and the rigid planar member (34) of the assembly (100*a*) having a plurality of vertically oriented stiffener members (33) comprising of vertically oriented (Continued)

welded strips (33*a*) of steel disposed with stiffener elements (33*b*) at spatial intervals along the length of said welded strips of steel (33*a*). Aforementioned pair of face plates (28, 32) further being disposed at respective outer surfaces (28*a*, 32*a*) with a plurality of horizontal stiffener members (22).

20 Claims, 8 Drawing Sheets

(51) Int. Cl.
*E04H 9/02* (2006.01)
*E04B 1/24* (2006.01)

(56) References Cited

U.S. PATENT DOCUMENTS

| | | | | |
|---|---|---|---|---|
| 5,732,802 | A * | 3/1998 | Tsukagoshi | E04B 1/98 188/378 |
| 7,124,547 | B2 * | 10/2006 | Bravinski | E02D 27/02 249/191 |
| 8,807,307 | B2 * | 8/2014 | Choi | E04H 9/02 188/105 |
| 9,316,014 | B2 * | 4/2016 | Chou | E04H 9/14 |
| 9,593,487 | B2 * | 3/2017 | Harvey | E04B 2/10 |
| 2004/0035073 | A1 * | 2/2004 | Bravinski | E02D 27/02 52/426 |
| 2015/0204097 | A1 * | 7/2015 | Chou | E04H 9/14 52/167.1 |
| 2016/0069063 | A1 * | 3/2016 | Harvey | E04B 2/10 52/125.2 |

* cited by examiner

WALL PANEL DAMPING DEVICE

CROSS REFERENCE TO RELATED APPLICATIONS

This application is the National Stage of International Application No. PCT/MY2015/050153, filed on Dec. 15, 2015, which claims the benefit of Malaysian Application No. PI2014703806, filed on Dec. 15, 2014. The contents of both applications are hereby incorporated by reference in their entirety.

The present invention relates to the broad field of vibration damping. More particularly, the present invention relates to a damping device for use in structures such as steel and reinforced concrete buildings that are subjected to dynamic loads. Most particularly, the present invention relates to a wall panel damping device.

BACKGROUND TO THE INVENTION

It is known that increasing the damping in a structure will result in the improvement in the response and performance of a structure under earthquake vibrations, wind forces or any structural stability hazard of similar nature. All structures have inherent damping which causes them to stop vibrating. This damping is the result of internal factors such as damping of the material of the structure, the movement in the connections or external factors such as air resistance. Typically damping in a structure can approximately vary between 2% to 7%. With the use supplemental dampers, damping can be increased substantially to a desirable value of 15% to 25% or more. With the use of supplemental dampers, the damping of vibrations due to any structural stability hazard such as undesirable vibrations caused by an earthquake can be further mitigated. More particularly, with the use of supplemental dampers, damping can be increased substantially to a desirable value of 15% to 25% or more.

Among the different kinds of structural damping systems, solid viscoelastic dampers due to their inherent advantages, have been extensively studied for uses in relation to the protection of buildings against vibration and lateral movement (Housener, 1997). Rubber is usually the solid viscoelastic material employed in damper systems used for base isolation in buildings to protect superstructures against ground shaking (Islam, A. 2013, Gueguen, P. 2012) or in machine foundations to diminish in exemplary cases, engine vibrations (Chehab, 2003). Rubber has also been known to be utilized in seismic isolation pads that provide for the decoupling between a building and a foundation.

As mentioned before, rubber materials are mostly used as base isolations in foundations of buildings, but in recent research studies, new kinds of viscoelastic dampers have been proposed which are used as wall dampers. Ibrahim et. al. (2007) investigated a new viscoelastic damping device which consists of a block of a high damping rubber sandwiched between steel plates which provided additional energy dissipation. Cho and Kwon (2004) proposed a system to improve the performance of reinforced concrete (RC) frame structures under earthquake loads. The wall-type damper has an advantage in the retro-fit of RC structures. The system consists of a Teflon slider and a RC wall (i.e. a friction type damper). The damper is also designed to control normal pressures acting on a frictional slider. The damper as proposed by Cho and Kwon (2004) appears to be effective in mitigating seismic responses of RC frame structures and reducing damage to RC structural members. Experimental results suggests that use of friction type dampers as proposed by Cho and Kwon (2004), can not only reduce structural seismic responses but can also prevent stress concentrations which usually take place at the connection between brace-type dampers and its joining RC members. However, owing to the inherent characteristics of friction dampers, the friction wall damper is not suitable for alleviating wind-induced or low intensity earthquake excited structural responses.

Studies on viscoelastic wall type dampers appear to suggest that similar to ordinary viscoelastic dampers, the performance of viscoelastic wall type dampers are also affected by factors that include variance in environmental temperature and strain amplitude of the viscoelastic material layer. Accordingly, thus far, an efficient control effect cannot always be achieved. In contrast, viscous wall type dampers, appear to provide a better option when taking into consideration wind and seismic response control of building structures.

In accordance to the state of the art, it appears that a lot of research has focused on the development of viscous wall dampers as opposed to viscoelastic wall damper devices. Due to a readily available supply of rubber, it may be advantageous to develop a viscoelastic wall panel damping device that utilizes rubber as the viscoelastic damping element. It may further be advantageous to develop a viscoelastic wall panel damping device that exhibits appreciable wind and seismic response control.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

This summary is provided to introduce a selection of concepts in a simplified form that are further described below in the detailed description. This summary is not intended to identify key features or essential features of the claimed subject matter.

It is an advantage of the present invention to provide a viscoelastic damping device that utilizes damping elements comprising rubber.

It is an advantage of the present invention to provide a viscoelastic damping device that provides damping against multidirectional reacting loads that include in-plane shear force resistance and out of plane force resistance.

It is an advantage of the present invention to provide a viscoelastic damping device that can further serve as a wall panel in steel and/or reinforced concrete structures.

In one aspect, the present invention provides a viscoelastic wall panel damping device that provides damping against multidirectional reacting loads that include in-plane shear force resistance and out of plane force resistance; the viscoelastic wall panel damping device comprises of:

- an assembly having a pair of symmetrically opposing surfaces, the assembly comprising of a plurality of alternating layers of viscoelastic damping element planar members and rigid planar members; each of the plurality of viscoelastic damping element, planar members and each of the plurality of rigid planar members having a first surface and a second symmetrically opposing surface;
- a pair of face plates, a proximal face plate and a distal face plate that overlay the assembly formed by the plurality of alternating layers of viscoelastic damping element planar members and rigid planar members at the symmetrically opposing surfaces; the pair of face plates having an inner surface and an outer surface;

the inner surface of the pair of face plates and the first and second surfaces of the plurality of rigid planar members being disposed with a plurality of vertically oriented stiffeners comprising of vertically oriented welded strips of steel disposed with stiffener elements at spatial intervals along the length of the welded strips of steel.

In accordance with the abovementioned preferable embodiment of the present invention, the viscoelastic wall panel damping device further includes;

a pair of connecting members, a first connecting member and a second connecting member that cooperate to enable the interconnection of the assembly overlaid by the pair of face plates at the symmetrically opposing surfaces of the assembly to a preexisting frame structure of a building; the first connecting member being interconnected to the pair of face plates overlaying the assembly formed by the plurality of alternating layers of viscoelastic damping element planar members and rigid planar members, and the second connecting member being interconnected to the plurality of rigid planar members of the assembly; and a pair of edge members, a first edge member and a second edge member that serve to maintain axial or longitudinal compression of the assembly formed by the plurality of alternating layers of viscoelastic damping element planar members and plurality of rigid planar members;

In accordance with yet another preferable embodiment of the viscoelastic wall panel damping device of the present invention, said viscoelastic wall-panel damping device including:

an assembly having a pair of symmetrically opposing surfaces, the assembly comprising of a pair of damping element planar members sandwiching a rigid planar member; each of said pair of damping element planar members and said rigid planar member having a first surface and a second symmetrically opposing surface; and a pair of face plates, a proximal face plate and distal face plate that respectively overlay the assembly at the symmetrically opposing surfaces of the assembly; the proximal face plate and distal face plate each having an inner surface and an outer surface;

the inner surface of the pair of face plates and the first and second surfaces of the rigid planar member being disposed with a plurality of vertically oriented stiffeners comprising of vertically oriented welded strips of steel disposed with stiffener elements at spatial intervals along the length of the welded strips of steel.

In accordance with the abovementioned preferred embodiment of the present invention, the viscoelastic damping device further includes a pair of connecting members, a first connecting member and a second connecting member that serve to enable the interconnection of the assembly overlaid at its symmetrically opposing surfaces by the pair of face plates, to a pre-existing frame structure of a building; the first connecting member being interconnected to the pair of face plates overlaying the assembly formed by the pair of viscoelastic damping element planar members sandwiching the rigid planar member; the second connecting member being interconnected to the rigid planar member of the assembly; and a pair of edge members, a first edge member and a second edge member that serve to maintain axial or longitudinal compression of the assembly formed by the sandwiching of the rigid planar member by the pair of viscoelastic damping element planar members;

In accordance with a preferable embodiment of the viscoelastic wall panel damping device of the present invention, the pair of face plates, i.e. the proximal and distal face plates further include a plurality of horizontally oriented stiffener bars disposed on the outer surface.

In accordance with a preferred embodiment of the viscoelastic wall panel damping device of the present invention, the inner surface of the proximal face plate and the inner surface of the distal plate is disposed at spatial intervals with three vertically oriented stiffeners; each of the vertically oriented stiffeners comprising of a welded strip of steel and a pair of stiffener elements.

In accordance with a preferred embodiment of the viscoelastic wall panel damping device of the present invention, the first and second symmetrically opposing surfaces of the rigid planar member are respectively disposed with a pair of vertically oriented stiffeners; each of the vertically oriented stiffeners comprising of a welded strip of steel and a pair of stiffener elements.

BRIEF DESCRIPTION OF THE DRAWINGS

The above and other objects, features and other advantages of the present invention will be more clearly understood from the detailed description taken in conjunction with the accompanying drawings, in which.

Figure 5:
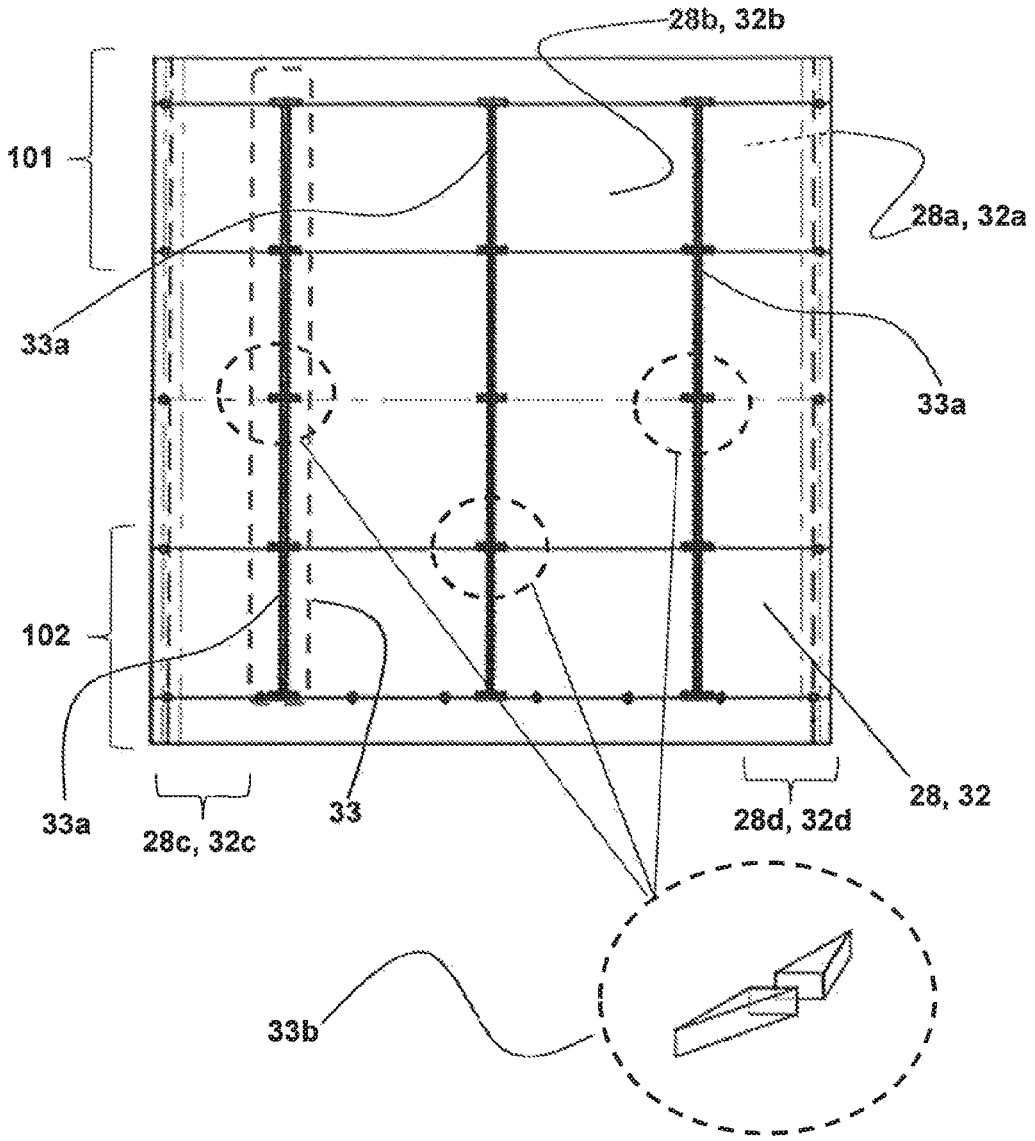
Figure 6:
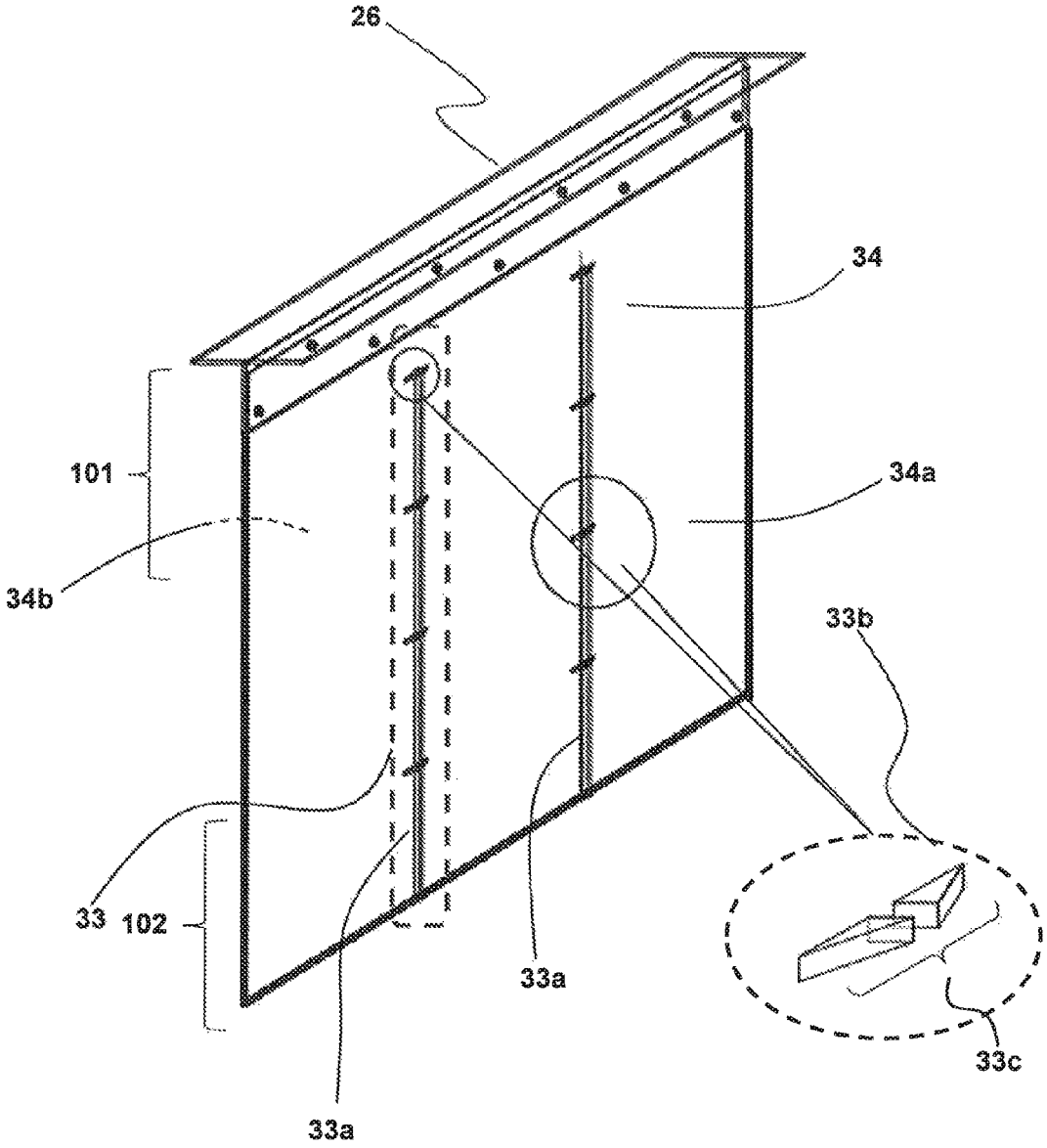
Figure 7:
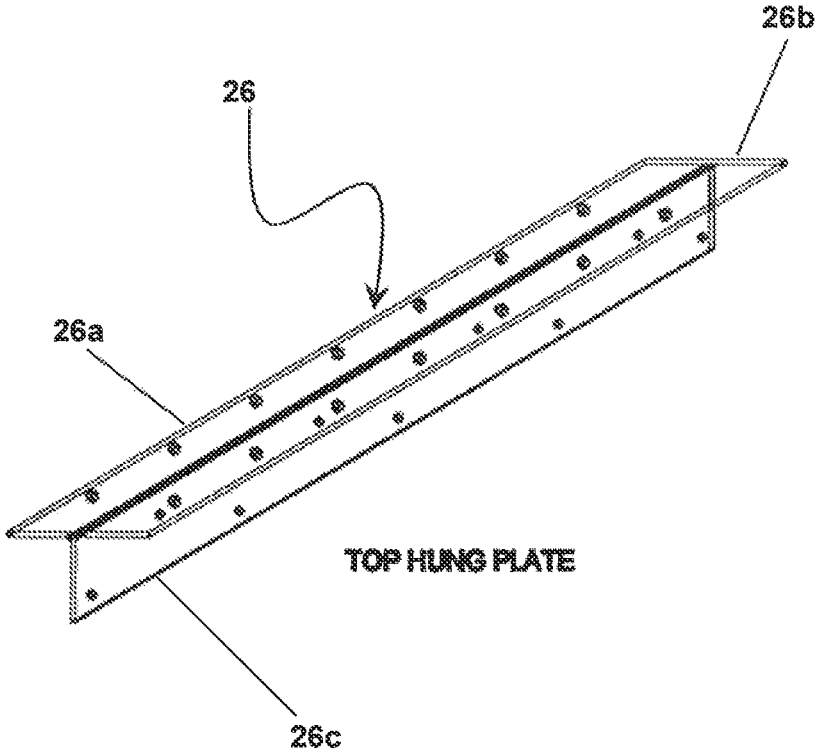
Figure 8:
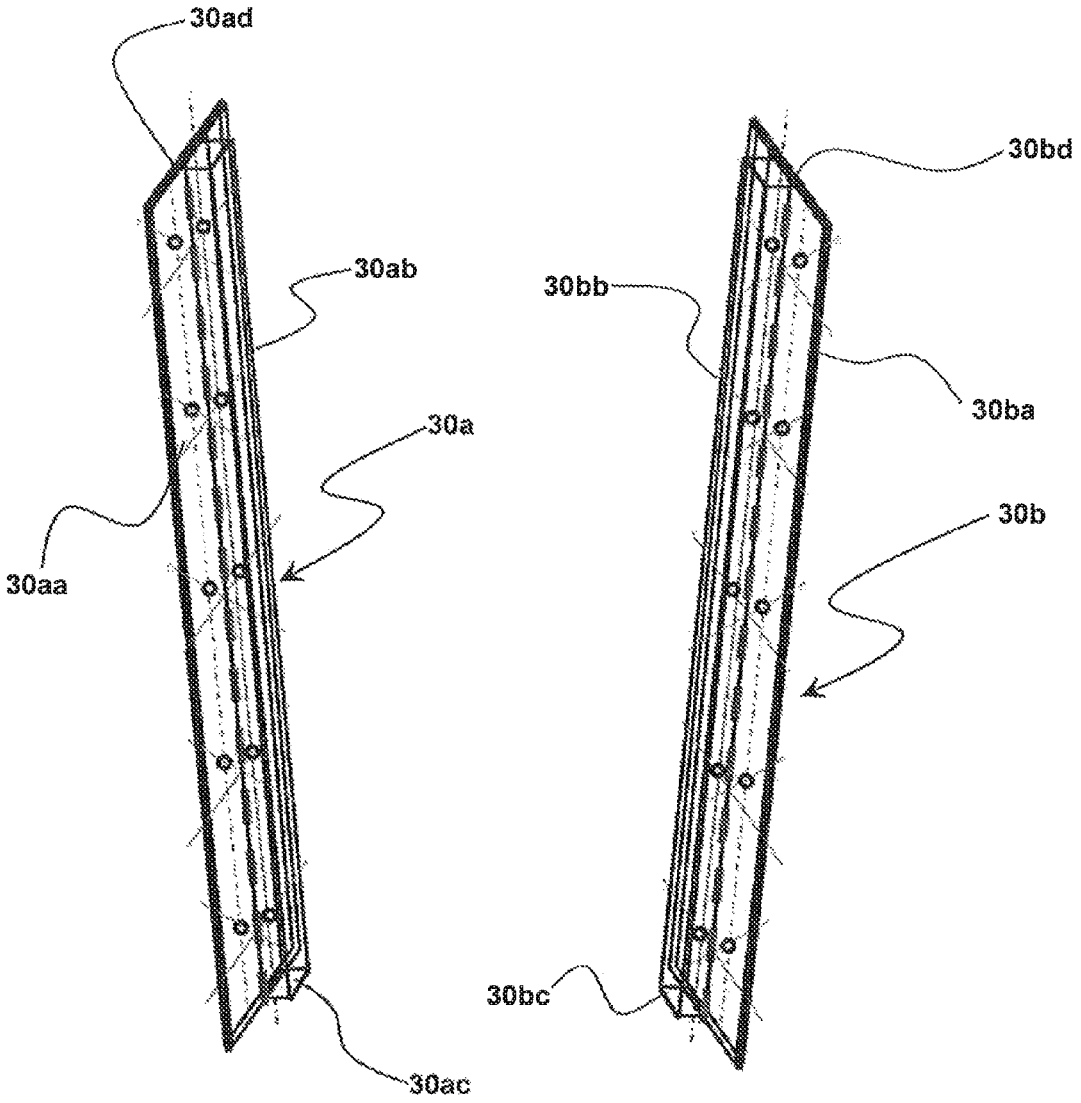

FIG. **4*a*** is a diagram illustrating horizontal cross sectional view of a bottom portion of the viscoelastic wall panel damping device in accordance with a preferable embodiment of the present invention in which an exploded plan view of the first connecting member that is interconnected to an edge member is provided;

FIG. **4*b*** is a diagram illustrating a perspective view of the first connecting member of the viscoelastic wall panel damping device in accordance with a preferable embodiment of the present invention;

FIG. 5 is a diagram of a side elevation view of a proximal face plate of the viscoelastic wall panel damping device in accordance with a preferable embodiment of the present invention in which an inner surface of the proximal face plate is shown;

FIG. 6 is a perspective view of a rigid member interconnected to a second connecting member of the viscoelastic wall panel damping device in accordance with a preferable embodiment of the present invention;

FIG. 7 is a perspective view of a second connecting member of the viscoelastic wall panel damping device in accordance with a preferable embodiment of the present invention; and FIG. 8 is a perspective view of an edge member of the viscoelastic wall panel damping device in accordance with a preferable embodiment of the present invention.

DETAILED DESCRIPTION OF THE INVENTION

The detailed description set forth below in connection with the appended drawings is intended as a description of an exemplary embodiment and is not intended to represent the only form in which the embodiment may be constructed and/or utilized. The description sets forth the functions and the sequence for constructing the exemplary embodiment. However, it is to be understood that the same or equivalent functions and sequences may be accomplished by different embodiments that are also intended to be encompassed within the scope of this disclosure.

Figure 1:
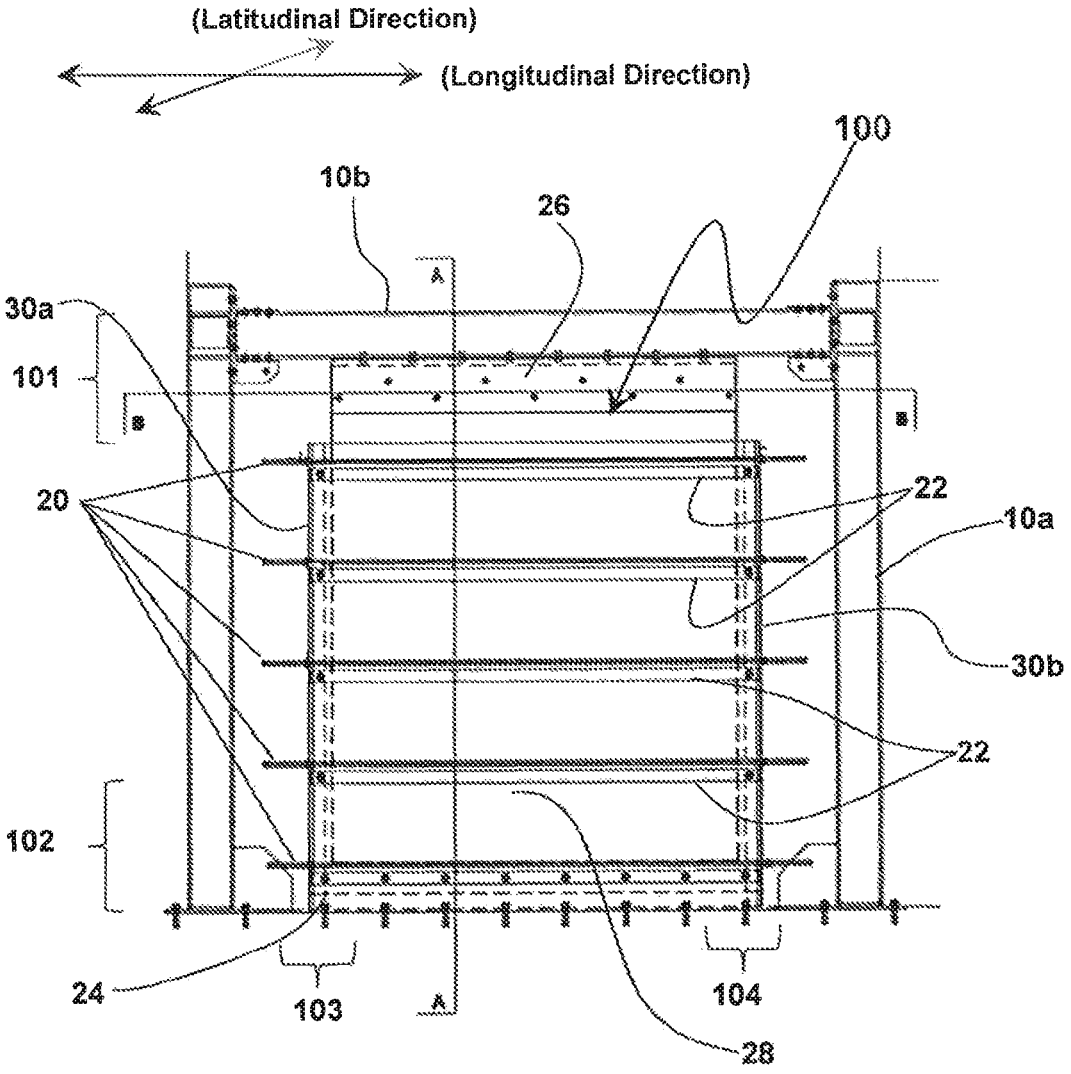
FIG. 1 is a side elevation view of the viscoelastic wall panel damping device in accordance with a preferable embodiment of the present invention.
Figure 2:
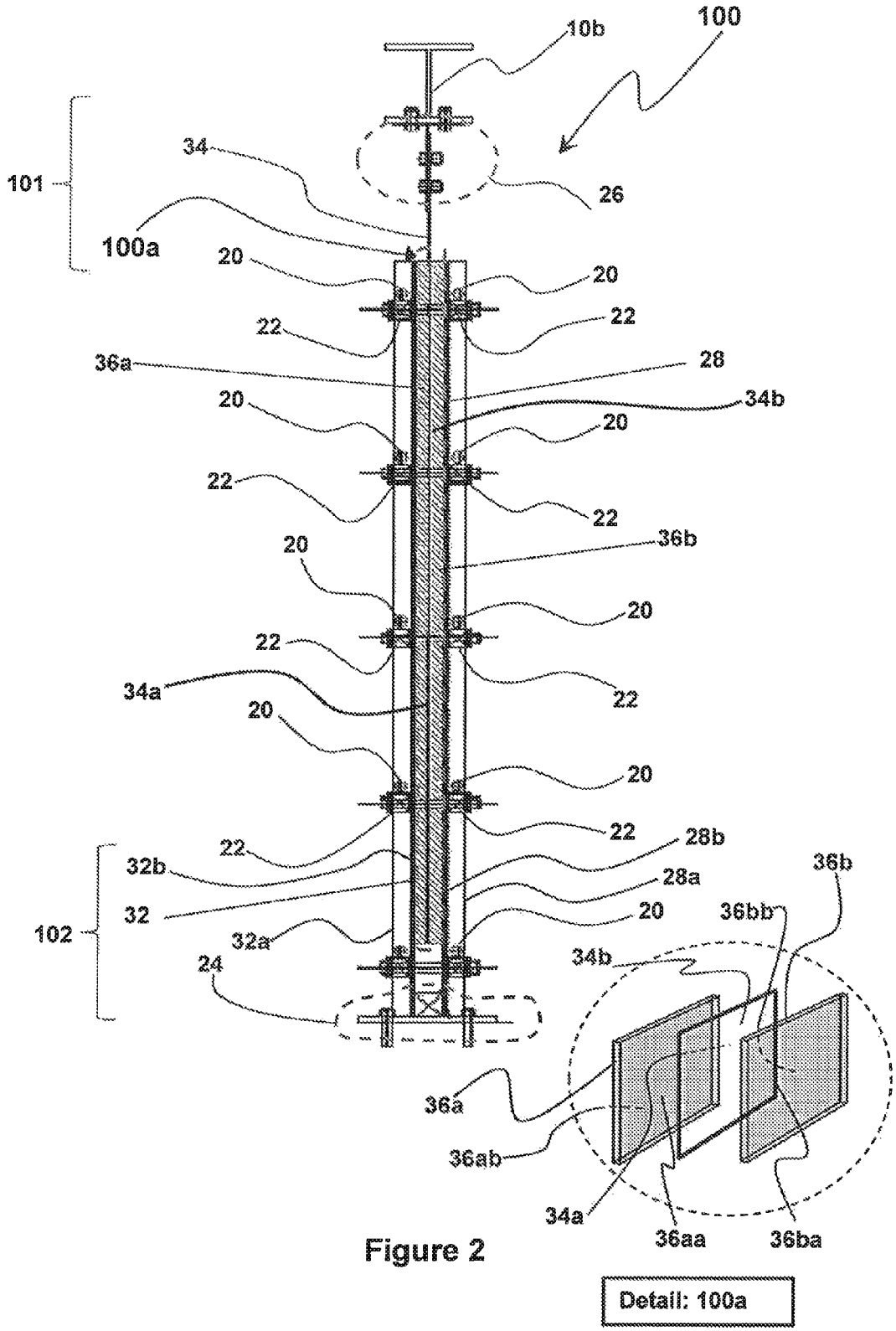
FIG. 2 is a vertical cross sectional view along line A-A as indicated in FIG. 1 of the viscoelastic wall panel damping device in accordance with a preferable embodiment of the present invention.
Figure 3:
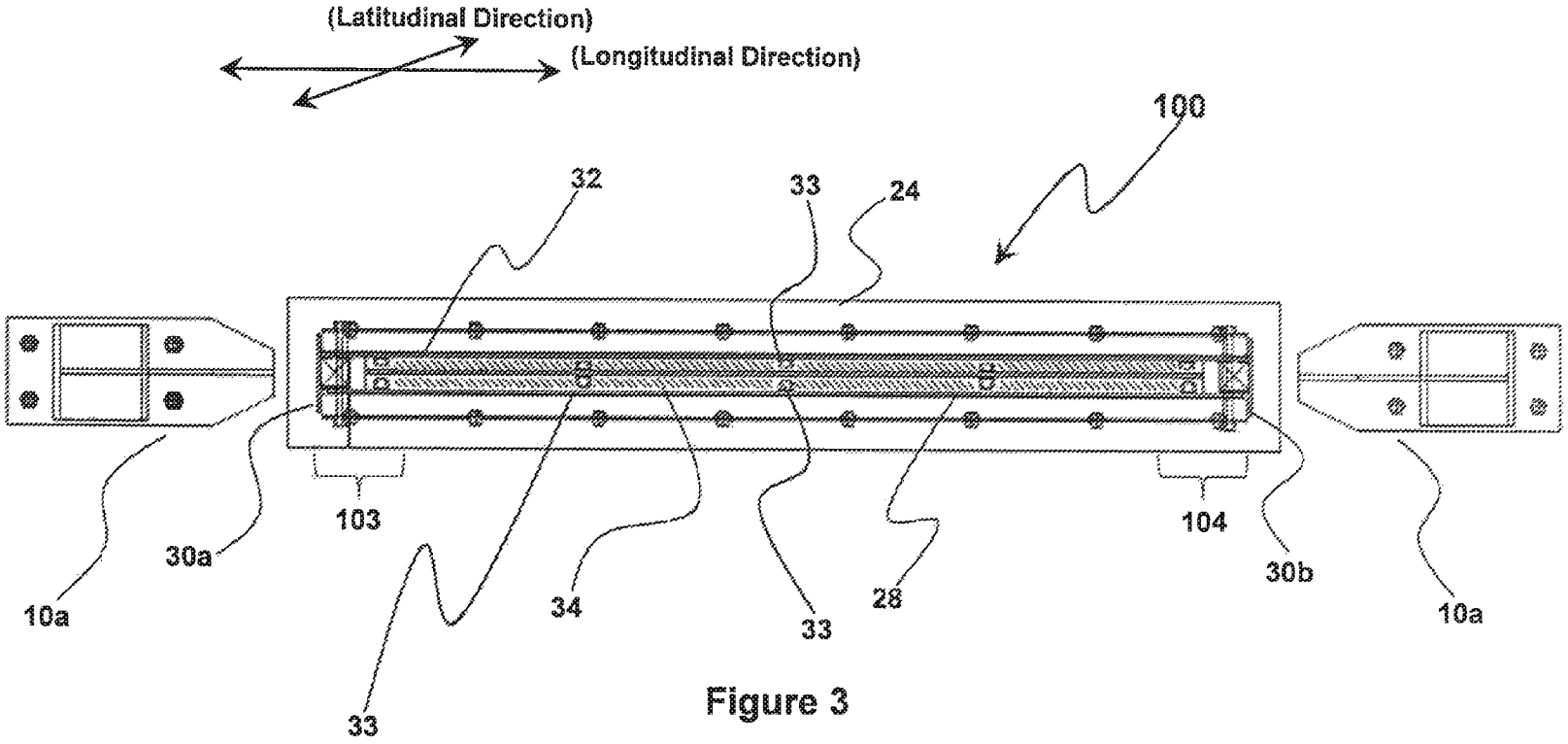
FIG. 3 is a horizontal cross sectional view along line B-B in FIG. 1 of the viscoelastic wall panel damping device in accordance with a preferable embodiment of the present invention.

With reference to the appended FIGS. 1 to 8, a preferable embodiment of the wall panel damping device of the present invention will now be described. With reference to FIG. 1, there is shown a side elevation view of a viscoelastic wall panel damping device 100 in accordance to a preferable embodiment of the present invention. FIG. 2, as mentioned in a preceding section of this document illustrates a cross-sectional view taken along lines A-A of the preferable embodiment of the viscoelastic wall panel damping device 100 of the present invention and FIG. 3 depicts another cross-sectional view taken along lines B-B of the preferable embodiment of the viscoelastic wall panel damping device 100 of the present invention. More particularly, with reference to FIGS. 1, 2, and 3, the viscoelastic wall panel damping device 100 of the present invention, in accordance with a preferable embodiment, comprises an assembly 100*a* having a pair of symmetrically opposing surfaces formed by a pair of damping element planar members 36*a*, 36*b*; the assembly 100*a* comprising of a pair of damping element planar members 36*a*, 36*b* sandwiching a rigid planar member 34; each of said pair of damping element planar members 36*a*, 36*b* and said rigid planar member 34 having a first surface 36*aa*, 36*ba*, 34*a* and a second symmetrically opposing surface 36*ab*, 36*bb*, 34*b*.

The viscoelastic damping device 100 of the present invention further including a pair of face plates 28, 32; a proximal face plate 28 and a distal face plate 32 that respectively overlay the assembly 100*a* at the symmetrically opposing surfaces formed by the pair of damping element planar members 36*a*, 36*b* of the assembly 100*a*. The pair of face plates 28, 32 overlaying and being in surface communication with the symmetrically opposing surfaces of the assembly 100*a* formed by the pair of damping element planar members 36*a*, 36*b*. The proximal face plate 28 and distal face plate 32 each having an inner surface 28*b*, 32*b* and an outer surface 28*a*, 32*a*, with the inner surface 28*b*, 32*b* of the pair of face plates 28, 32 and the first 34*a* and second surfaces 34*b* of the rigid planar member 34 being disposed with a plurality of vertically oriented stiffener members 33. In accordance with a preferable embodiment of the viscoelastic wall panel damping device 100 of the present invention as illustrated in FIGS. 1 through 3, the pair of face plates 28, 32, i.e. the proximal 28 and distal 32 face plates further include a plurality of horizontally oriented stiffener members 22 disposed on the outer surface 28*a*, 32*a*.

With reference to FIGS. 5 and 6 and the preceding paragraphs of this detailed description, each of the plurality of vertically oriented stiffener members 33 comprising of a vertically oriented welded strip of steel 33*a* disposed with stiffener elements 33*b* at spatial intervals along the vertical length of the welded strip of steel 33*b*. Said stiffener elements 33*b*, in accordance to a preferable embodiment of the viscoelastic damping device 100 of the present invention comprising of a pair of triangular steel elements 33*c* welded to symmetrically opposing sides of the welded strip of steel 33*a* of the plurality of vertically oriented stiffener members 33.

Reference is again made to FIGS. 1, 2 and 3, in accordance to a preferable embodiment, the viscoelastic wall panel damping device 100, further comprises a pair of connecting members 24, 26. A first connecting member 24 and a second connecting member 26 that respectively serve to enable the interconnection of the assemblage formed by the assembly 100*a* overlaid at its symmetrically opposing surfaces by the pair of face plates 28, 32, to a pre-existing frame structure 10*a*, 10*b* of a building, i.e. an elevated or base horizontal frame structure 10*a* and/or a pair of vertical frame structures 10*b*. The first connecting member 24 being interconnected to the pair of face plates 28, 32 overlaying the assembly 100*a* formed by the pair of viscoelastic damping element planar members 36*a*, 36*b* sandwiching the rigid planar member 34; the second connecting member 26 being interconnected to the rigid planar member 34 of the assembly 100*a*. The aforementioned preferable embodiment of the viscoelastic damping device 100 of the present invention, yet further including a pair edge members 30*a*, 30*b*, a first edge member 30*a* and a second edge member 30*b*, that each respectively serve to maintain axial or longitudinal compression of the assembly 100*a* formed by the sandwiching of the rigid planar member 34 by the pair of viscoelastic damping element planar members 36*a*, 36*b*. As may be evident in FIGS. 1 through 3 and FIG. 4, the pair of the first edge member 30*a* and the second edge member 30*b*, are in surface communication with the assembly 100*a* formed by the sandwiching of the pair of damping element planar members 36*a*, 36*b* of the planar rigid member 34; and the pair of face plates 28, 32 that overlay said assembly 100*a*. Aforementioned pair of edge members 30*a*, 30*b* serving to maintain axial or longitudinal compression of the assembly 100*a* formed by the sandwiching of the rigid planar member 34 by the pair of viscoelastic damping element planar members 36*a*, 36*b* in cooperation with a plurality of threaded tie rod members 20, as may be evident from aforementioned FIGS. 1, 2 and 3.

With reference to FIG. 8, in accordance to a preferable embodiment of the damping device 100 of the present invention, the pair of edge members 30*a*, 30*b* each respectively comprising of a steel plate member 30*ad*, 30*bd*, disposed with a projecting member 30*ac*, 30*bc*. The projecting member 30*ac*, 30*bc* of each edge member 30*a*, 30*b* of the pair of edge members 30*a*, 30*b* being oriented vertically with respect to the orientation of the steel plate member 30*ad*, 30*bd* and is further in surface communication with the projecting member 30*ac*, 30*bc*. More particularly, aforementioned first edge member 30*a*, comprises of a steel plate member 30*ad* disposed with a projecting member 30*ac*. Aforementioned projecting member 30*ac* of the first edge member 30*a* being oriented vertically with respect to the orientation of the steel plate member 30*ad* and further being in surface communication with said steel plate member 30*ad*. Similarly, aforementioned second edge member 30*b*, comprises of a steel plate member 30*bd* disposed with a projecting member 30*bc*. Aforementioned projecting member 30*bc* of the second edge member 30*b* being oriented vertically with respect to the orientation of the steel plate member 30*bd* of said second edge member 30*b* and further being in surface communication with said steel plate member 30*bd*. The resulting structure of the pair of edge members 30*a*, 30*b* respectively, appear to be formed such that each edge member 30*a*, 30*b* has a pair of flanges 30*aa*, 30*ab* and 30*ba*, 30*bb*. More particularly, edge member 30*a* appears to have a pair of flanges 30*aa*, 30*ab* and edge member 30*b* appears to have a pair of flanges 30*ba*, 30*bb*. The pair of flanges 30*aa*, 30*ab* of the first edge member 30*a* being disposed with threaded perforations distributed at spatial intervals along the vertical length of said flanges 30*aa*, 30*ab* of the first edge member 30*a* and, similarly the pair of flanges 30*ba*, 30*bb* of the second edge member 30*b* being disposed with threaded perforations distributed at spatial intervals along the vertical length of said flanges 30*ba*, 30*bb*.

With reference to FIGS. 1, 2, 3 and 8, said plurality of threaded perforations along the vertical lengths of the flanges 30*aa*, 30*ab*, 30*ba*, 30*bb* of the pair of edge members 30*a*, 30*b* serving to enable securing of the pair of edge members 30*a*, 30*b* to the assemblage formed by the surface communication overlaying of the proximal and distal face plates 28, 32 of the assembly 100*a* comprising of the pair of planar damping elements 36*a*, 36*b* and the rigid planar member 34, at symmetrically opposing edge ends 103, 104 with the aid of a plurality of threaded tie rod members 20 and plurality of bolts and nuts to consequently form the viscoelastic wall panel damping device 100 of the present invention. The securing of the pair of edge members 30*a*, 30*b* at symmetrically opposing edge ends 103, 104 of the assemblage formed by the surface communication overlaying of the proximal and distal face plates 28, 32 of the assembly 100*a* comprising of the pair of planar damping elements 36*a*, 36*b* and the rigid planar member 34, with the aid of a plurality of threaded tie rod members 20 and a plurality of bolts and nuts enable the pair of edge members 30*a*, 30*b* to maintain axial or longitudinal compression of the assemblage (i.e. the assemblage formed by the overlaying of the pair of face plates 28, 32 of the assembly comprising of the pair of damping element members 36*a*, 36*b* and the rigid planar member 34).

Figure 4A:
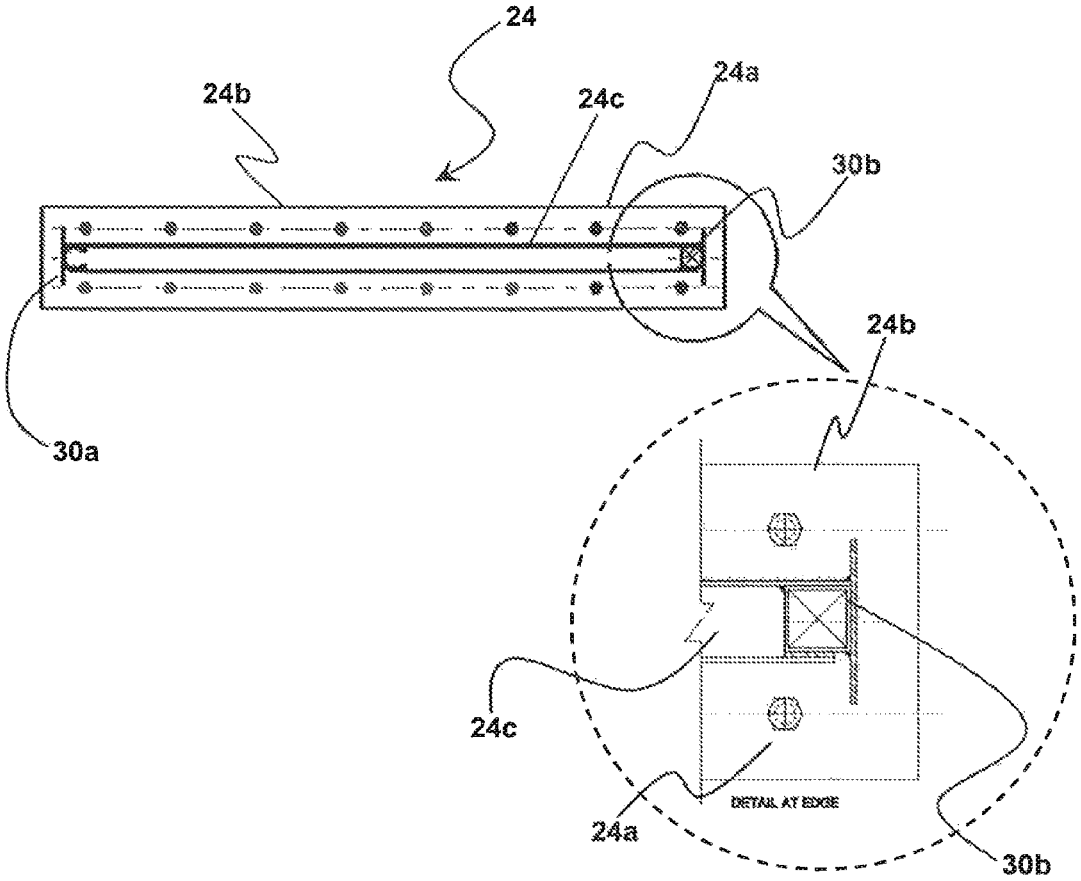
Figure 4B:
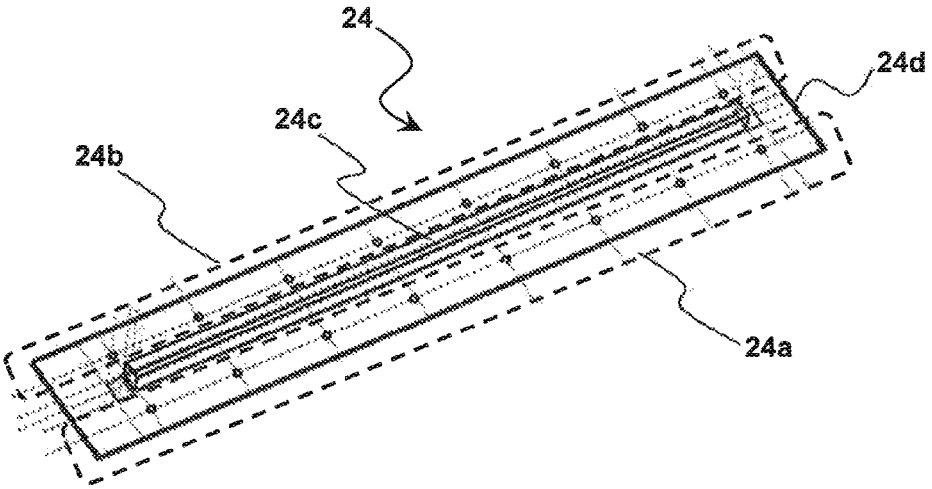

With reference to FIGS. 4*a* and 4*b*, the first connecting member 24 in accordance to a preferable embodiment of the viscoelastic wall panel damping device 100 of the present invention, includes a pair of flanges 24*a*, 24*b* that flank a projecting element 24*c* which in accordance to a preferable embodiment, of the present invention, is a hollow longitudinally extending square tubular projecting element 24*c*. The pair of flanges 24*a*, 24*b* being disposed with threaded perforations distributed along the longitudinal length of said flanges 24*a*, 24*b* to enable the securing of said first connecting member 24 on to a pre-existing frame structure 10*a*, 10*b* of a building via the use of a plurality of bolts and nuts.

With reference to FIGS. 6 and 7, the second connecting member 26, similar to the first connecting member 24 includes a pair of flanges 26*a*, 26*b* that flank a projecting element 26*c*, which in accordance with a preferable embodiment of the viscoelastic wall panel damping device 100 of the present invention is a projecting sheet 26*c* that extends longitudinally throughout the longitudinal length of the pair of flanges 26*a*, 26*b*. In accordance to a preferable embodiment of the viscoelastic wall panel damping device 100 of the present invention, the pair of flanges 26*a*, 26*b* being disposed with threaded perforations distributed along a horizontal length of said flanges 26*a*, 26*b* to enable the securing of said second connecting member 26 on to a pre-existing frame structure 10*a*, 10*b* of a building via the use of a plurality of bolts and nuts. In addition to the threaded perforations of the pair of flanges 26*a*, 26*b*, the projecting sheet 26*c* is also disposed with threaded perforations at spatial intervals throughout its longitudinal length to hence enable the securing of said second connecting member 26 onto the rigid planar member 34 of the assembly 101*a* comprising of the pair of planar damping element members 36*a*, 36*b* and the rigid planar member 34.

With reference to FIG. 6, the rigid planar member 34 of the assembly 100*a* that is overlaid by the pair of face plates 28, 32, i.e. the proximal face plate 28 and the distal face plate 32; comprises of a pair of symmetrically opposing surfaces 34*a*, 34*b*, a first surface 34*a* and a second symmetrically opposing surface 34*b*. Said first surface 34*a* and second symmetrically opposing surface 34*b* of the rigid planar member 34 being disposed with a plurality of vertically oriented stiffener members 33. The rigid planar member 34 being further disposed with a plurality of perforations (not explicitly shown) located at the top periphery (i.e. top side 101) of said rigid planar member 34 that correspond to the plurality of threaded perforations disposed on the projecting sheet 26*c* of the second connecting member 26 to enable the second connecting member 26 to be secured to the top side 101 of said rigid planar member 34.

In accordance to a preferable embodiment of the viscoelastic wall panel damping device 100 of the present invention, the rigid planar member 34 is disposed with a pair of vertically oriented stiffener members 33 at both its first surface 34*a* and its symmetrically opposing second surface 34*b*. The pair of vertically oriented stiffener members 33 being displaced by a predetermined spatial interval along the longitudinal length of said rigid planar member 34 at both its symmetrically opposing surfaces 34*a*, 34*b*.

With reference to FIG. 5, there is shown an elevation side view of a face plate 28, 32. It should be noted that in accordance to a preferable embodiment of the viscoelastic wall panel damping device 100 of the present invention, the pair of face plates 28, 32, i.e. the proximal face plate 28 and the distal face plate 32 are identical in construction. Each of the pair of face plates 28, 32 having a first inner surface 28*b*,32*b* and a second symmetrically opposing outer surface 28*a*, 32*a*. Both aforementioned inner 28*b*, 32*b* and outer 28*a*, 32*a* surfaces including a plurality of vertically oriented stiffener members 33. Each vertically oriented stiffener member 33 as may have been mentioned in a preceding paragraph of this description, comprising of a vertically oriented welded strip of steel 33*a* disposed with stiffener elements 33*b* at spatial intervals along the vertical length of the welded strip of steel 33*b*. Said stiffener elements 33*b*, in accordance to a preferable embodiment of the viscoelastic damping device 100 of the present invention comprising of a pair of triangular steel elements 33*c* welded to symmetrically opposing sides of the welded strip of steel 33*a* of an individual vertically oriented stiffener member 33. Each of the face plates 28, 32 being further disposed with a plurality of threaded perforations adapted to receive a plurality of bolts, at symmetrically opposing side edges 28*c*, 32*c* and 28*d*, 32*d*.

In accordance with a preferable embodiment of the viscoelastic wall panel damping device 100 of the present invention, each of the pair of face plates 28, 32, i.e. the proximal face plate 28 and the distal face plate 32 include three vertically oriented stiffener members 33 that are displaced by spatial intervals along the longitudinal direction disposed at the inner surfaces 28*b*, 32*b*.

With reference to FIGS. 1, 2 and 5, it would be understood by a person of ordinary skill in the art, that the plurality of threaded perforations at the symmetrically opposing side edges 28*c*, 32*c* and 28*d*, 32*d* of each of the pair of face plates 28, 32 are in spatial alignment with corresponding perforations (not shown) disposed on each of the plurality of horizontal stiffener members 22 disposed on the outer surfaces 28*a*, 32*a* respectively of the proximal face plate 28 and distal face plate 32. The plurality of perforations disposed on the symmetrically opposing side edges 28*c*, 32*c* and 28*d*, 32*d* of each of the pair of face plates 28, 32 are distributed at spatial intervals along the vertical length of said pair of face plates 28, 32. In yet another preferable embodiment of the viscoelastic wall panel damping device 100 of the present invention, the plurality of horizontal stiffener members 22 are weldably secured to the respective outer faces 28*a*, 32*a* of said proximal 28 and distal 32 face plates.

In accordance to a preferable embodiment of the viscoelastic wall panel damping device 100 of the present invention, the plurality of vertically oriented stiffener members 33 disposed on the inner surfaces 28*b*, 32*b* of the proximal face plate 28 and the distal face plate 32 respectively; and the plurality of vertically oriented stiffener members 33 disposed on the first and second surfaces 34*a*, 34*b* of the rigid planar member 34; are disposed such that said plurality of vertically oriented stiffener members 33 of the pair face plates 28, 32 and said plurality of vertically oriented stiffener members 33 of the rigid planar member 34 are not in latitudinal spatial alignment.

The formation or assembly of the viscoelastic wall-panel damping device 100 in accordance to a preferable embodiment of the present invention, will now be described with reference to the appended FIGS. 1 to 10. With reference to FIGS. 1 through 3, the viscoelastic wall panel damping device 100 of the present invention, comprises of an assembly 100*a* that is formed by the sandwiching of the pair of planar damping element members 36*a*, 36*b* of a rigid planar member 34. Aforementioned rigid planar member 34 and aforementioned pair of damping element planar members 36*a*, 36*b* having the same length and width dimensions, as may be apparent by the views presented in FIGS. 1 through 3. Said assembly 100*a* being overlaid by the pair of face plates 28, 32, i.e. the proximal face plate 28 and the distal face plate 32 such that said proximal face plate 28 and said distal face plate 32 are respectively in surface communication with the symmetrically opposing sides of the assembly 100*a* formed by the pair damping element planar members 36*a*, 36*b*. Said pair of face plates 28, 32 i.e. the proximal face plate 28 and the distal face plate 32 extending to a length in the longitudinal direction that is slightly greater on either end 103, 104 than the length in the longitudinal direction of the assembly 100*a* formed by the sandwiching by the pair of damping element planar members 36*a*, 36*b* of the rigid planar member 34 as is evident in FIG. 3.

Prior to sandwiching of the rigid planar member 34 with the pair of damping element planar members 36*a*, 36*b*; aforementioned rigid planar member 34 is connected to the second connecting member 26 with the aid of a plurality of bolts and nuts in accordance to a preferable embodiment of the viscoelastic wall panel damping device 100, that are threaded through the plurality of threaded perforations disposed along the longitudinal length of the projecting sheet 26*c* of said second connecting member 26 and the plurality of perforations (not shown) disposed on the top side 101 of the planar rigid member 34 and when the plurality of perforations (not shown) of the rigid planar member 34 and the plurality of threaded perforations disposed on the projecting sheet 26*c* of the second connecting member 26 are in alignment. The plurality of bolts are secured in position by way of a plurality of nuts, thus forming the assemblage that appears on FIG. 6.

With reference to FIGS. 1 through 4*b*, the first connecting member 24 is disposed at the bottom side 102 of the viscoelastic wall panel damping device 100 in accordance to a preferable embodiment of the present invention. More particularly, aforementioned first connecting member 24 is disposed at the bottom side of the viscoelastic wall panel damping device 100 such that the symmetrically opposing faces of the projecting member 24*c* of said first connecting member 24 is in surface communication, at the bottom side 102, with the inner surfaces 28*b*, 32*b* of the pair of face plates 28, 32 that overlay the assembly 100*a* comprising of the pair of damping element planar members 36*a*, 36*b* and the rigid planar member 34. Further said first connecting member 24 is disposed at the bottom side 102 of the viscoelastic wall panel damping device 100 such that the flanges 24*a*, 24*b* of said first connecting member 24 is in surface communication with the bottom edges of the pair of face plates 28, 32 that overlay the assembly 100*a*. In view of the above, said first connecting member 24 is snugly fit at the bottom side 102 to the assemblage comprising of the pair of face plates 28, 32 overlaying in surface communication the assembly 100*a* comprising of the pair of damping element planar members 36*a*, 36*b* and the rigid planar member 34.

Again, by way of reference to FIGS. 1 through 4*a* and FIG. 8, the entire assemblage formed by the surface communication overlaying of the pair of face plates 28, 32 at symmetrically opposing sides of the assembly 100*a* formed by the pair of damping element planar members 36*a*, 36*b* sandwiching the rigid planar member 34 is maintained in axial or longitudinal compression by a pair of edge members 30*a*, 30*b* acting in cooperation with a plurality of threaded tie rod members 20. More particularly, aforementioned pair of edge members 30*a*, 30*b* are disposed on the symmetrically opposing edge ends 103, 104 of the assemblage formed by the pair of face plates 28, 32 and the assembly 100*a*, such that the opposing faces of the of the projecting member 30*ac*, 30*bc* of each edge member 30*a*, 30*b* are in surface communication with the inner surfaces 28*b*, 32*b* of the pair of face plates 28, 32 that overlay the assembly 100*a*, and the flanges 30*aa*, 30*ab* and 30*ba* and 30*bb* of each edge member 30*a*, 30*b* is in surface communication with the edges of said pair of face plates 28, 32.

The pair of edge members 30*a*, 30*b* being secured to the assemblage formed by the surface communication overlaying of the pair of face plates 28, 32 at symmetrically opposing surfaces of the assembly 100*a* formed by the pair of damping element planar members 36*a*, 36*b* and the rigid planar member 34 by threading a plurality of threaded tie rod members 20 through perforations disposed at spatial intervals along the vertical length of the each of the flanges 30*aa*, 30*ab* and 30*bb*, 30*ba* of the first edge member 30*a* and the second edge member 30*b*. Said plurality of threaded tie rod members 20 threaded through the aforementioned perforations disposed on the flanges 30*aa*, 30*ab* and 30*ba*, 30*bb* of the first and second edge members 30*a*, 30*b* respectively, such that said plurality of tie rod members 20 extend through the entire longitudinal length of the pair of face plates 28, 32 that overlay the assembly 100*a*. Said plurality of threaded tie rod members 20 being secured in position with the aid of a plurality of nuts.

Finally, to complete the assembly or the formation of the viscoelastic wall panel damping device 100 in accordance to a preferable embodiment of the present invention, a plurality of horizontal stiffener members 22 are secured on both the outer surfaces 28*a*, 32*a* of the pair of face plates 28, 32 with the aid of a plurality of bolts and nuts. The bolts are threaded through the corresponding perforations disposed on the side edges 28*c*, 32*c* and 28*d*, 32*d* of the pair of face plates 28, 32 which are in alignment with the perforations disposed on each horizontal stiffener member 22.

In view of the fact that, said pair of face plates 28, 32 i.e. the proximal face plate 28 and the distal face plate 32 extending to a length in the longitudinal direction that is slightly greater on either end 103,104 than the length in the longitudinal direction of the assembly 100*a* formed by the sandwiching of the pair of damping element planar members 36*a*, 36*b* and the rigid planar member 34 as is evident in FIG. 3, a common bolt is threaded through the perforations of a pair of corresponding horizontal stiffener members 33 disposed respectively on the outer surface 28*a* of the proximal face plate 28 and the outer surface 32*a* of the distal face plate 32, the perforations of the horizontal stiffener member 33 being in alignment with corresponding perforations disposed on the corresponding side edges 28*c*, 32*c* and 28*d*, 32*d* of the pair of face plates 28, 32, thus enabling the securing of a pair of horizontal stiffener members 22 with the aid nuts on the assemblage formed by the surface communication overlaying of the pair face plates 28, 32 of the assembly 100*a* comprising of the pair damping element planar member 36*a*, 36*b* and the rigid planar member 34.

The resulting assemblage being the viscoelastic wall panel damping device 100 in accordance to a preferable embodiment of the present invention.

The invention claimed is:

1. A viscoelastic wall panel damping device (100), for providing damping against multidirectional reacting loads that include in-plane shear force resistance and out of plane force resistance, the viscoelastic wall panel damping device (100) comprising:

an assembly (100*a*) having a plurality of alternating layers of viscoelastic damping element planar members (36*a*, 36*b*) and rigid planar members (34); each of the plurality of viscoelastic damping element planar members (36*a*, 36*b*) and each of the plurality of rigid planar members (34) having a first surface (36*aa*, 36*ba*, 34*a*) and a second symmetrically opposing surface (36*ab*, 36*ba*, 34*b*);

a pair of face plates (28, 32), a proximal face plate (28) and a distal face plate (32) that overlay the assembly (100*a*) formed by the plurality of alternating layers of viscoelastic damping element planar members (36*a*, 36*b*) and rigid planar members (34) at the symmetrically opposing surfaces, the pair of face plates (28, 32) having an inner surface (28*b*, 32*b*) and an outer surface (28*a*, 32*a*);

the inner surface (28*b*, 32*b*) of the pair of face plates (28, 32) and the first (34*a*) and second (34*b*) surfaces of the plurality of rigid planar members (34) being disposed with a plurality of vertically oriented stiffeners members (33) comprising of vertically oriented welded strips of steel (33*a*) disposed with stiffener elements (33*b*) at spatial intervals along a vertical length of the welded strips of steel (33*a*).

2. The viscoelastic wall panel damping device (100) according to claim 1, wherein the pair of face plates (28, 32) are disposed with a plurality of horizontal stiffener members (22) at respective outer surfaces (28*a*, 32*a*).

3. The viscoelastic wall panel damping device (100) according to claim 1, wherein the stiffener elements (33*b*) of the plurality of vertically oriented stiffener members (33) comprise of a pair triangular pieces of steel (33*c*) disposed on symmetrically opposing sides of the strip of steel (33*a*).

4. The viscoelastic wall panel damping device (100) according to claim 1, wherein the first connecting member (24) is interconnected to a pre-existing horizontal base frame structure (10*b*) or concrete base via a pair of flanges (24*a*, 24*b*) flanking the projecting member (24*c*) of the first connecting member (24).

5. The viscoelastic wall panel damping device (100) according to claim 1, wherein the assembly (100*a*) comprises of a pair of viscoelastic damping element planar members (36*a*, 36*b*) that sandwich a rigid planar member (24).

6. The viscoelastic wall panel damping device (100) according to claim 5, wherein the viscoelastic wall panel damping device (100) further includes a pair of edge members (30*a*, 30*b*), a first edge member (30*a*) and a second edge member (30*b*) disposed at edge ends (103, 104) of said viscoelastic wall panel damping device (100) and secured in position.

7. The viscoelastic wall panel damping device (100) according to claim 5, wherein the pair damping element planar members (36*a*, 36*b*) are high damping rubber damping planar members.

8. The viscoelastic wall panel damping device (100) according to claim 5, wherein the pair of face plates (28, 32) are disposed with a plurality of horizontal stiffener members (22) at respective outer surfaces (28*a*, 32*a*).

9. The viscoelastic wall panel damping device (100) according to claim 5, wherein the stiffener elements (33*b*) of the plurality of vertically oriented stiffener members (33) comprise of a pair triangular pieces of steel (33*c*) disposed on symmetrically opposing sides of the strip of steel (33*a*).

10. The viscoelastic wall panel damping device (100) according to claim 5, wherein the first connecting member (24) is attached to the pair of face plates (28, 32) overlaying the assembly (100*a*) via a projecting via a projecting member (24*c*) of the first connecting member (24).

11. The viscoelastic wall panel damping device (100) according to claim 10, wherein the first connecting member (24) is interconnected to a pre-existing horizontal base frame structure (10*b*) or concrete base via a pair of flanges (24*a*, 24*b*) flanking the projecting member (24*c*) of the first connecting member (24).

12. The viscoelastic wall panel damping device (100) according to claim 5, wherein the second connecting member (26) is interconnected to the rigid planar member (34) of the assembly (100*a*) via a projecting sheet (26*c*) of the second connecting member (26).

13. The viscoelastic wall panel damping device (100) according to claim 12, wherein the second connecting member (26) is interconnected to a pre-existing elevated horizontal frame structure via a pair of flanges (26*a*, 26*c*) of the second connecting member (26).

14. The viscoelastic wall panel damping device (100) according to claim 5, wherein the viscoelastic wall panel damping device (100) further including a pair of connecting members (24, 26), a first connecting member (24) and a second connecting member (26).

15. The viscoelastic wall panel damping device (100) according to claim 14, wherein the first connecting member (24) is attached to the pair of face plates (28, 32) overlaying the assembly (100*a*) via a projecting via a projecting member (24*c*) of the first connecting member (24).

16. The viscoelastic wall panel damping device (100) according to claim 14, wherein the viscoelastic wall panel damping device (100) further includes a pair of edge members (30*a*, 30*b*), a first edge member (30*a*) and a second edge member (30*b*) disposed at edge ends (103, 104) of said viscoelastic wall panel damping device (100) and secured in position.

17. The viscoelastic wall panel damping device (100) according to claim 14, wherein the pair damping element planar members (36*a*, 36*b*) are high damping rubber damping planar members.

18. The viscoelastic wall panel damping device (100) according to claim 14, wherein the stiffener elements (33*b*) of the plurality of vertically oriented stiffener members (33) comprise of a pair triangular pieces of steel (33*c*) disposed on symmetrically opposing sides of the strip of steel (33*a*).

19. The viscoelastic wall panel damping device (100) according to claim 14, wherein the second connecting member (26) is interconnected to the rigid planar member (34) of the assembly (100*a*) via a projecting sheet (26*c*) of the second connecting member (26).

20. The viscoelastic wall panel damping device (100) according to claim 19, wherein the second connecting member (26) is interconnected to a pre-existing elevated horizontal frame structure via a pair of flanges (26*a*, 26*c*) of the second connecting member (26).

* * * * *